US006405699B1

(12) United States Patent
Church

(10) Patent No.: US 6,405,699 B1
(45) Date of Patent: Jun. 18, 2002

(54) ROLLER FOLLOWER GUIDE ORIENTATION AND ANTI-ROTATION FEATURE

(75) Inventor: Kynan L. Church, Ceresco, MI (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/925,363

(22) Filed: Aug. 9, 2001

(51) Int. Cl.[7] ..... F01L 1/14; F01L 1/46
(52) U.S. Cl. ..... 123/90.5; 123/90.16
(58) Field of Search ..... 123/90.15, 90.16, 123/90.48, 90.5, 198 F

(56) References Cited

U.S. PATENT DOCUMENTS

| | | | | |
|---|---|---|---|---|
| 3,108,580 A | * | 10/1963 | Crane, Jr. | 123/90.5 |
| 4,448,155 A | | 5/1984 | Hillebrand et al. | 123/90.5 |
| 5,088,455 A | | 2/1992 | Moretz | 123/90.5 |
| 5,307,769 A | | 5/1994 | Meagher et al. | 123/90.5 |
| 5,398,648 A | * | 3/1995 | Spath et al. | 123/90.16 |
| 5,431,133 A | * | 7/1995 | Spath et al. | 123/90.16 |
| 5,934,232 A | * | 8/1999 | Greene et al. | 123/90.16 |
| 6,196,175 B1 | * | 3/2001 | Church | 123/90.16 |

* cited by examiner

*Primary Examiner*—Weilun Lo
(74) *Attorney, Agent, or Firm*—L. J. Kasper

(57) ABSTRACT

A valve actuation sub-assembly for an internal combustion engine, the sub-assembly being adapted for attachment to an engine block (11B) and including a conventional roller follower (21) and a deactivating roller follower (47). The sub-assembly comprises a follower guide member (71) defining a first guide receptacle (81) for receiving an upper portion (87) of the conventional roller follower (21), and a second guide receptacle (83) for receiving an upper portion (93) of the deactivating roller follower (47). In accordance with the invention, neither upper portion (87,93) will be received within the guide receptacle (81,83) intended for the other upper portion, thus preventing assembly errors, wherein one roller follower type is installed in a location on the engine intended for the other roller follower type.

6 Claims, 6 Drawing Sheets

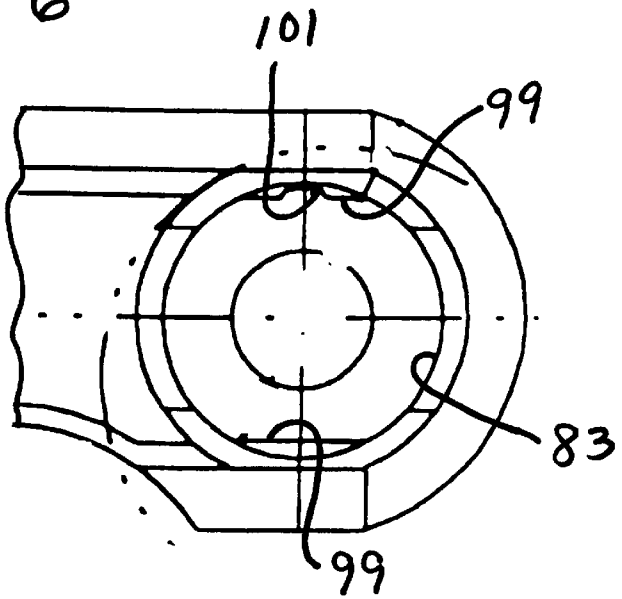
FIG. 6
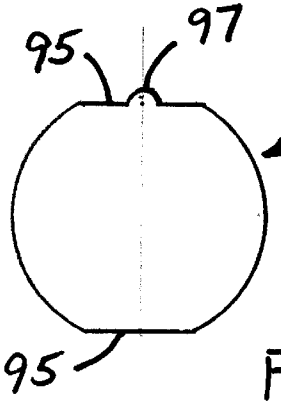
FIG. 8
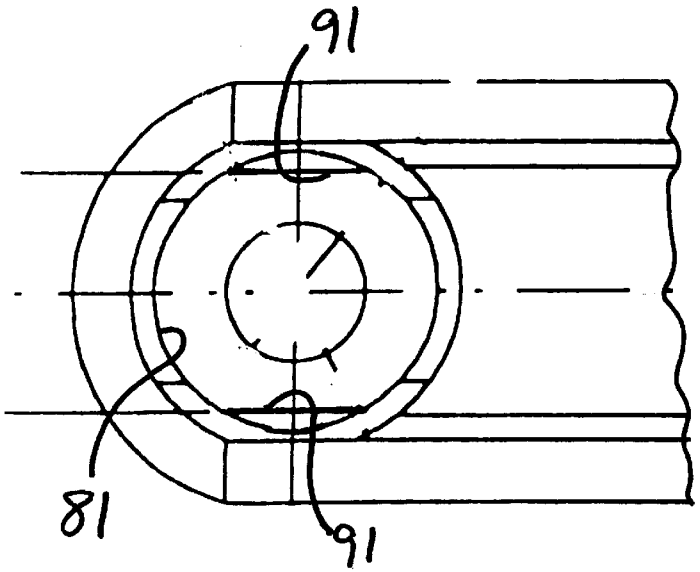
FIG. 7
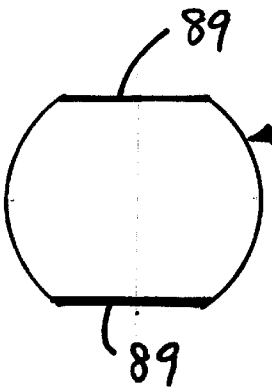

ROLLER FOLLOWER GUIDE ORIENTATION AND ANTI-ROTATION FEATURE

BACKGROUND OF THE DISCLOSURE

The present invention relates to an improved valve gear train for an internal combustion engine, and more particularly, to a valve deactivator sub-assembly for use therein.

Although the valve deactivator sub-assembly of the present invention may be utilized to introduce some additional lash into the valve train, such that the valves open and close by an amount less than the normal opening and closing, the invention is especially suited for introducing into the valve train sufficient lash (also referred to hereinafter as "lost motion"), such that the valves no longer open and close at all, and the invention will be described in connection therewith.

Valve deactivators of the general type to which the invention relates are known, especially in connection with internal combustion engines having push rod type valve gear trains in which there is a rocker arm, with one end of the rocker arm engaging the push rod, and the other end engaging the engine poppet valve. Typically, a central portion of the rocker arm is fixed relative to the cylinder head (or other suitable structure) by a fulcrum arrangement as is well know to those skilled in the art, in which the fulcrum normally prevents movement of the central portion of the rocker arm in an "up and down" direction. At the same time, the fulcrum permits the rocker arm to engage in cyclical, pivotal movement, in response to the cyclical motion of the push rod, which results from the engagement of the push rod with the lobes of the rotating cam shaft.

There are a number of known valve deactivator sub-assemblies which are operably associated with the fulcrum portion of the rocker arm and which, in the latched condition, restrain the fulcrum portion of the rocker arm to move in its normal cyclical, pivotal movement. However, In an unlatched condition, the valve deactivator sub-assembly permits the fulcrum portion of the rocker arm to engage in "lost motion" such that the cyclical, pivotal movement of the push rod causes the rocker arm to undergo cyclical, pivotal movement about the end which is in engagement with the engine poppet valve. In other words, the rocker arm merely pivots, but the engine poppet valve does not move and therefore, is in its deactivated condition.

Although the known valve deactivator sub-assemblies of the type referred to above have performed in a generally satisfactory manner, such sub-assemblies do add substantially to the overall cost of the valve gear train, and in many cases also add undesirably to the space taken up by the overall rocker arm installation. In some engine designs, there is simply no room to add a valve deactivator sub-assembly of the type which is associated with the rocker arm fulcrum member.

Typically, in a push rod type of valve gear train, there is some sort of cam follower device having one portion thereof in engagement with the cam lobe on the engine cam shaft, and another portion thereof in engagement with the lower end of the push rod. It is also known for such a cam follower mechanism to include a hydraulic lash compensation element. It is now also known to incorporate a valve deactivator mechanism into the cam follower, thus eliminating the need for adding to the rocker arm assembly the type of expensive, space consuming structure described above.

On a normal internal combustion engine having valve gear train of the push rod type described above, and including some form of valve deactivation capability, it would be typical for less than all of the engine poppet valves to be equipped with the valve deactivation capability. In other words, on an eight cylinder engine, by way of example only, it would be typical to provide valve deactivation capability on both the intake and exhaust valves of four of the eight cylinders, while equipping the intake and exhaust valves of the other four cylinders with conventional roller followers. In such an engine configuration, installation of the proper roller follower at each location within the engine can be a problem because, typically, the valve deactivating roller follower and the conventional roller follower to be used in a particular engine would be the same overall size, shape, and configuration, such that during the engine assembly process, it would be very easy to put a valve deactivating roller follower in a location intended to have a conventional roller follower, or vice-versa.

It is known in valve gear train of the type to which this invention relates to provide some sort of guide member for the roller followers to prevent rotation of the roller followers about their longitudinal axes, in order to maintain the roller followers in their proper rotational orientation relative to the associated cam lobe. In other words, the axis of the roller of the roller follower must remain parallel to the axis of the cam shaft.

BRIEF SUMMARY OF THE INVENTION

Accordingly, it is an object of the present invention to provide an improved valve deactivator sub-assembly, including a guide member, which overcomes the above-described disadvantages of the prior art.

It is a more specific object of the present invention to provide an improved valve deactivator sub-assembly and guide member which will insure that deactivating roller followers are installed only at deactivation follower locations, and that conventional roller followers are installed only at conventional follower locations.

It is another object of the present invention to provide an improved valve deactivator sub-assembly, including a guide member, which accomplishes the above-stated objects, and which also insures that each roller follower is oriented correctly, rotationally, so that, for example, each fluid port in the roller follower is aligned with the correct fluid passage in the engine block.

The above and other objects of the invention are accomplished by the provision of a valve actuation sub-assembly for an internal combustion engine of a type having a valve means for controlling the flow to and from a combustion chamber, and valve gear means operative in response to a cyclical input motion to effect cyclical opening and closing of the valve means. The valve actuation sub-assembly is adapted for attachment relative to an engine block including a cam shaft defining first and second cam profiles operable to provide the cyclical input motion in response to rotation of the cam shaft. The engine block defines first and second follower bores disposed adjacent the first and second cam profiles, respectively. The valve actuation sub-assembly comprises first and second roller followers, to be disposed in the first and second follower bores, respectively, each of the roller followers including a roller for operative engagement with its respective cam profile, an outer body fixed to move axially with its roller, and the outer body including an upper portion projecting out of its respective follower bore. Each roller follower includes an inner body disposed within the outer body, and including a push rod socket, and a push rod in engagement with the socket and operable to transmit the cyclical input motion to the valve gear means. The valve actuation sub-assembly further comprises a follower guide member adapted for attachment to the engine block and defining first and second guide receptacles operable to receive and guide the upper portions of the outer body of the first and second roller followers, respectively.

The improved valve actuation sub-assembly is characterized by the first guide receptacle defining a first internal profile configured to be closely spaced relative to the upper portion of the outer body of the first roller follower. The first internal profile is not capable of receiving the upper portion of the outer body of the second roller follower. The second guide receptacle defines a second internal profile configured to be closely spaced relative to the upper portion of the outer body of the second roller follower. The second internal profile is not capable of receiving the upper portion of the outer body of the first roller follower.

In accordance with a further aspect of the invention, the valve actuation sub-assembly is characterized by the first roller follower comprising a conventional roller follower and the second roller follower comprising a deactivating roller follower. The second roller follower includes a latching arrangement operable between a latched condition, latching the inner body for movement with the outer body, and an unlatched condition, permitting relative axial movement between the outer body and the inner body.

BRIEF DESCRIPTION OF THE DRAWINGS

FIG. 6 is a broken, bottom plan view similar to FIG. 4, but on a larger scale, to illustrate the differences between the two types of guide receptacles in the present invention.

FIGS. 7 and 8 are simplified views of the external profiles of the upper portions of the outer bodies of the first and second roller followers, respectively, corresponding to the guide receptacles with which they are associated in FIG. 6.

DETAILED DESCRIPTION OF THE PREFERRED EMBODIMENT

Figure 1:
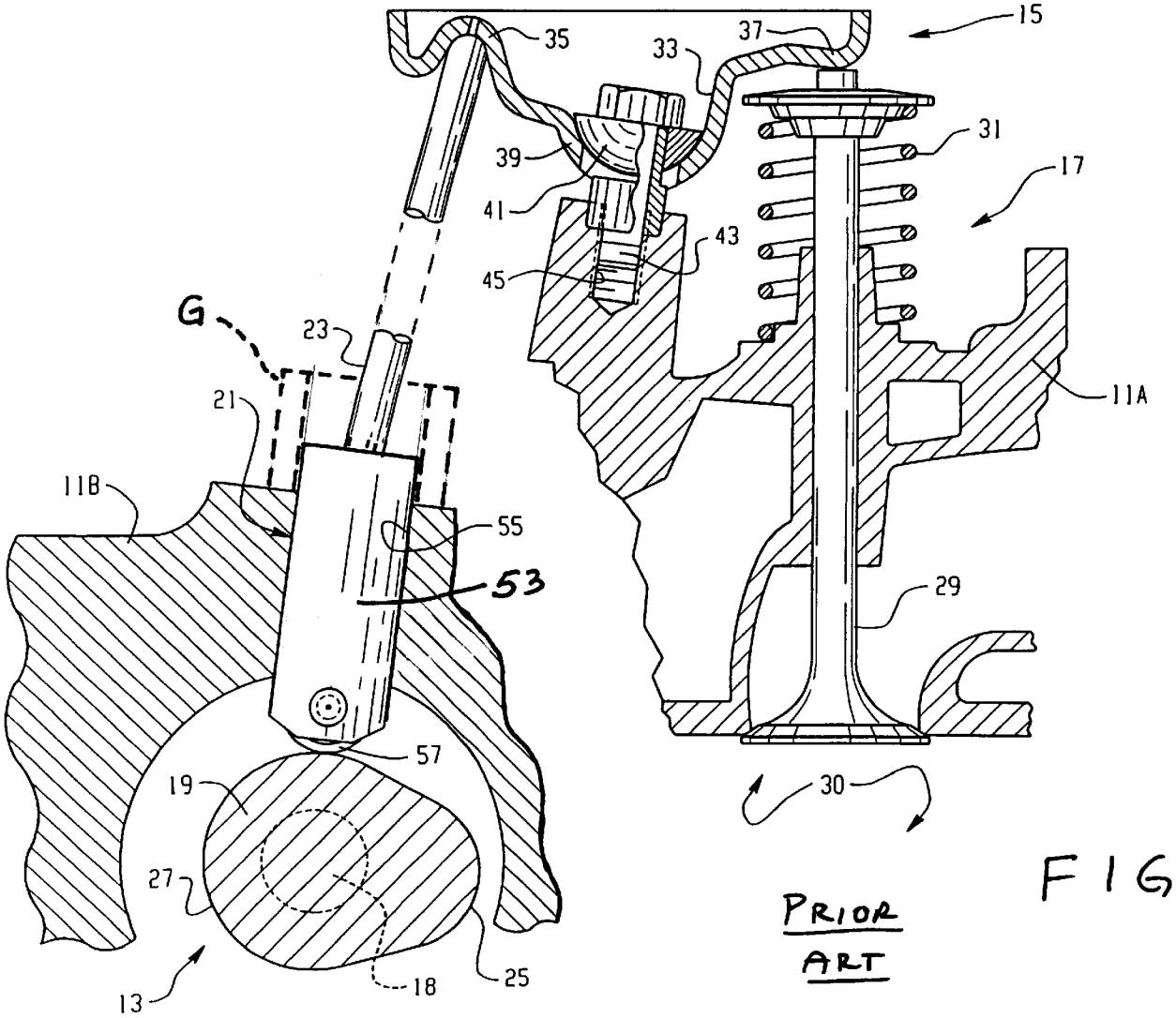
FIG. 1 PRIOR ART
FIG. 1 is a fragmentary, axial cross section taken through a vehicle internal combustion engine, illustrating a typical "PRIOR ART" valve gear train of the type with which the present invention may be utilized.

Referring to the drawings, which are not intended to limit the invention, FIG. 1 illustrates a valve actuating valve gear train of the push rod type, although it should be understood that the use of the present invention is not strictly limited to such. FIG. 1 illustrates a cylinder head 11A and an engine block 11B. On the engine block 11B is mounted a drive assembly 13, and on the cylinder head 11A is mounted a rocker arm assembly 15 and an engine poppet valve assembly, generally designated 17. Those skilled in the art will understand that the spatial relationship of the cylinder head 11A and engine block 11B, as shown in FIG. 1 are for ease of illustration only.

The drive assembly 13 includes a cam shaft 18 having a cam 19, a hydraulic roller follower 21, and a push rod 23. An example of a conventional hydraulic roller follower, not having valve deactivation capability, is illustrated and described in U.S. Pat. No. 4,607,599, assigned to the assignee of the present invention and incorporated herein by reference. The cam 19 includes a lift portion 25 and a dwell (base circle) portion 27. The poppet valve assembly 17 includes a poppet valve 29, operable to control flow to and from a combustion chamber 30, and further includes a spring 31 which biases the poppet valve toward the closed position shown in FIG. 1, as is well known to those skilled in the art.

The rocker arm assembly 15 includes a rocker arm 33 of the center-pivot type, the rocker arm 33 including one end 35 which is adapted to receive cyclical input motion from the push rod 23, and another end 37 which is adapted to transmit to the valve 29 the cyclical motion of the push rod 23. As a result, the engine poppet valve 29 has a cyclical opening and closing motion, corresponding to that of the push rod 23, all of which is well known to those skilled in the art. In the subject embodiment, the only motion of the rocker arm 33 is its pivotal movement, with the ends 35 and 37 engaging in alternating up and down movement.

The rocker arm 33 includes a pivot portion 39, disposed intermediate the ends 35 and 37, and a fulcrum 41 is disposed within the pivot portion 39 in a manner which permits the rocker arm 33 to pivot as described previously. The fulcrum 41 has a threaded mounting bolt 43 extending therethrough and being in threaded engagement with an internally threaded bore 45 defined by the cylinder head 11A. It should be understood that the present invention is not limited to any particular type or configuration of rocker arm or fulcrum arrangement.

Figure 5:
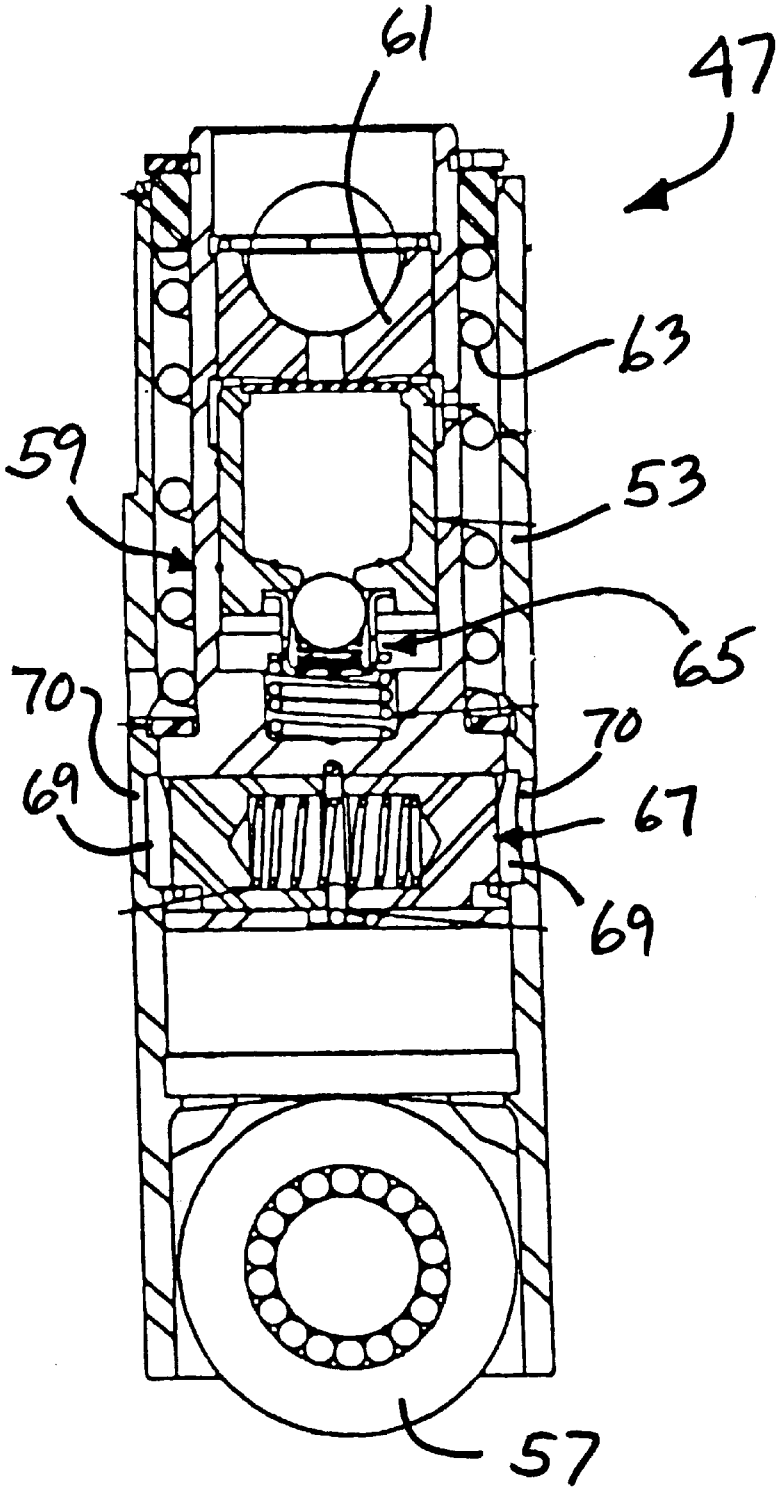
FIG. 5 is a substantially enlarged, axial cross section illustrating the valve deactivating roller follower which comprises part of the overall valve actuation sub-assembly of the present invention.

Typically, the present invention would be utilized with an eight cylinder engine for which the valve gear train would include eight pairs of intake and exhaust valves, and eight pair of intake and exhaust valve rocker arms. Four of the eight pairs would be equipped with a valve deactivator assembly, comprising a valve deactivating roller follower 47 (see FIGS. 2 and 5). In other words, four of the eight cylinders can be selectively deactivated by introducing sufficient "lost motion" into the valve drive train for that particular valve, so that the cyclical motion of the push rod 23 does not result in any corresponding cyclical opening and closing movement of the poppet valve 29 (i.e., of either the intake valve or the exhaust valve for that particular cylinder).

Figure 2:
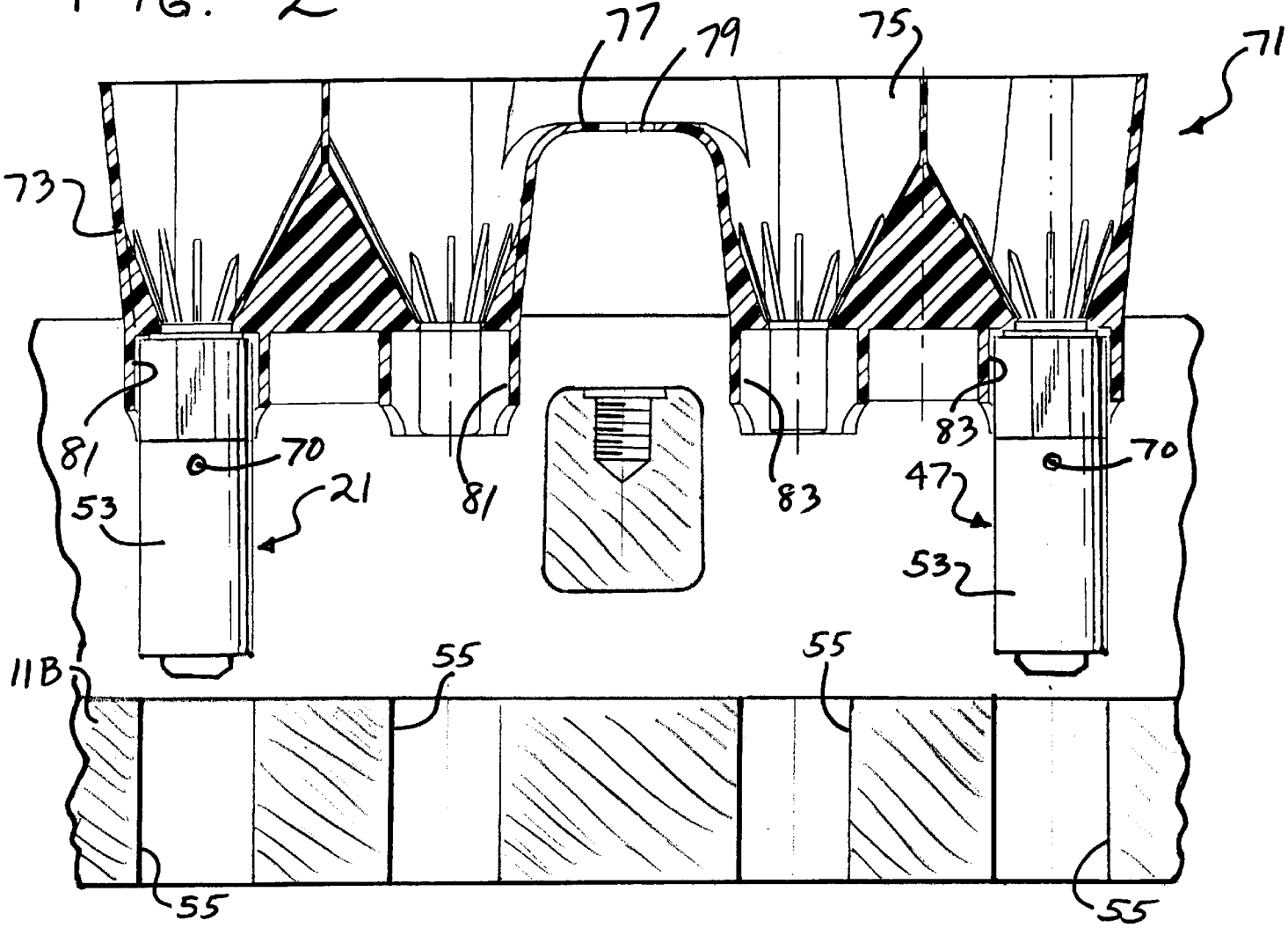
FIG. 2 is a fragmentary, transverse cross section, taken in a direction along the axis of the cam shaft shown in FIG. 1, illustrating one aspect of the present invention.

The other four of the eight cylinders would not be equipped with a valve deactivating device, but instead, would be equipped with one of the conventional hydraulic roller followers 21 (as shown in both FIGS. 1 and 2). The four pairs of intake and exhaust engine poppet valves 29 which are provided with the conventional roller followers 21, operate continually in their normal operating mode (i.e., there is never any "lost motion" introduced into the valve drive train for those particular valves), and as a result, rotation of the cam shaft 18 always results in cyclical motion of the push rod 23, and corresponding cyclical opening and closing movement of the poppet valves 29.

Referring now primarily to FIG. 2, as was indicated in the background of the disclosure, one of the problems associated with valve deactivating systems is making sure that the proper roller follower (whether a conventional roller follower 21 or a deactivating roller follower 47) is installed at each location. In addition, each deactivating roller follower 47 must be rotationally oriented correctly, as will be described subsequently in greater detail. Finally, it is important that each of the roller followers (both the conventional and the deactivating) is prevented from rotating about its axis, as will be discussed in greater detail subsequently.

Referring now to FIG. 2, in conjunction with FIG. 1, certain aspects of the present invention will be described. Each roller follower 21 or 47 includes an outer body member 53 which is disposed to reciprocate within a bore 55 in the engine block 11B. The outer body member 53 is in contact with, and follows its respective cam 19, through a conventional roller 57, shown herein in FIG. 5 as being of the needle roller bearing type. Those skilled in the art will understand that the invention is not limited to any particular roller follower design, or, by way of example, whether the axle of the roller is provided with needle bearings or merely a bushing, etc. Reciprocally disposed within the outer body member 53 is an inner body member 59 which includes a socket portion 61 to engage the lower end of the push rod 23. The inner body member 59 is biased upwardly in FIG. 5 toward its normal operating position by means of a lost motion spring 63.

Operably associated with the inner body member 59 is a hydraulic lash compensation element, generally designated 65, the details of which are well known to those skilled in the art, are not essential to the present invention, and therefore, will not be described further herein. Also operably associated with the inner body member 59 is a latching mechanism, generally designated 67. The mechanism 67 is of the spring applied, pressure released type. Therefore, the outer body member 53 defines an annular pressure passage 69 which is in fluid communication through port 70 with a source (not shown herein) of control pressure by means of an appropriate pressure passage (also not shown herein) in the engine block 11B. To the extent that the details of the construction and the operation of the valve deactivating roller follower 47 are not already well known to those skilled in the art, further understanding may be gained by reference to U.S. Pat. No. 6,196,175, assigned to the assignee of the present invention and incorporated herein by reference.

Referring again primarily to FIGS. 2–4, in accordance with an important aspect of the invention, a follower guide member, generally designated 71 is provided. To facilitate understanding of the invention, a prior art guide member, generally designated G, is shown in dashed lines in FIG. 1, with the guide member G being disposed in its assembled position. It should be understood that what is being shown in FIG. 2 is the follower guide member 71 as it is being lowered toward its installed position relative to the engine block 11B. However, in FIG. 2, for ease of illustration, there is only one of the roller followers 21 and only one of the deactivating roller followers 47 assembled to the guide member 71 whereas, in the actual practice of the subject embodiment, there would be two of the roller followers 21 and two of the deactivating roller followers 47 assembled to the guide member 71, as will become more readily apparent from the subsequent description.

Figure 3:
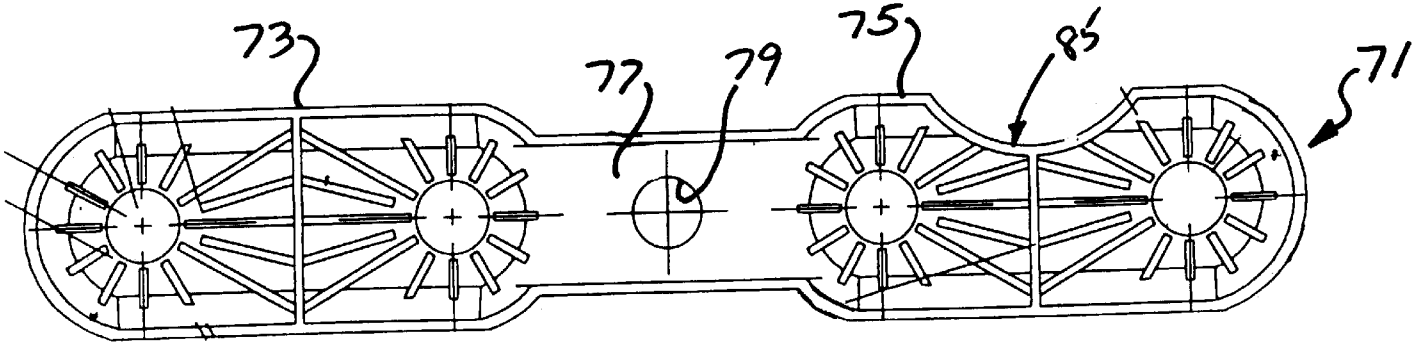
FIG. 3 is a top plan view of the follower guide member of the present invention, shown in axial cross section in FIG. 2, and on approximately the same scale.
Figure 4:
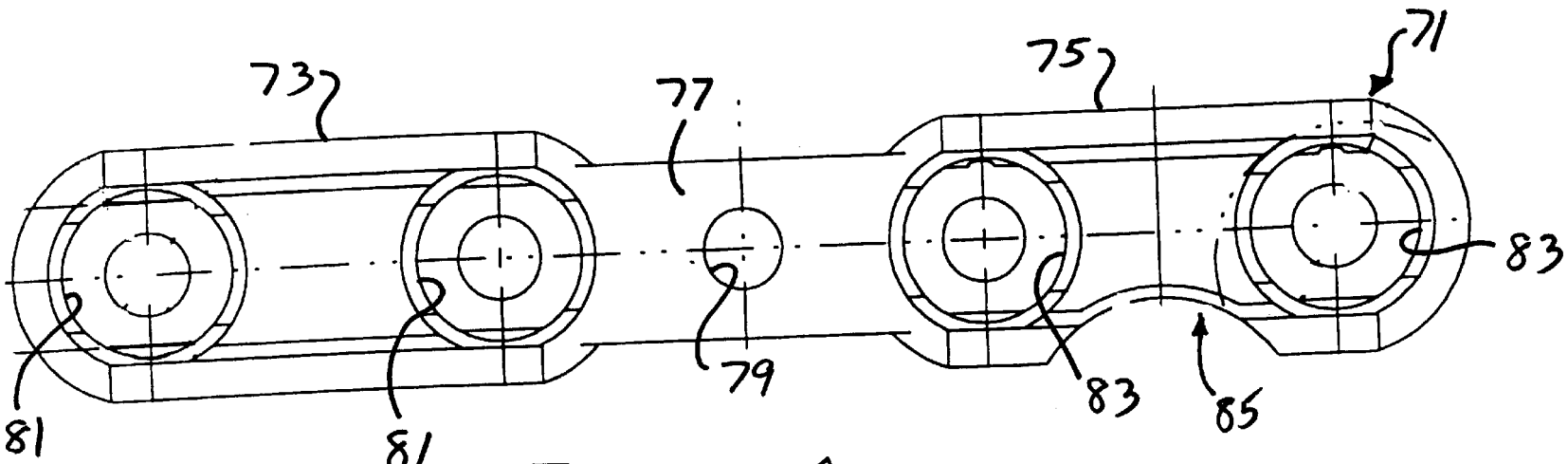
FIG. 4 is a somewhat enlarged bottom plan view of the follower guide member of the present invention, but with none of the roller followers in place.

Preferably, the follower guide member 71 comprises a molded plastic member, and in the subject embodiment, and by way of example only, the guide member 71 includes a conventional portion 73 and a deactivating portion 75, the portions 73 and 75 being joined by an intermediate portion 77, such that the guide member 71 comprises a single integral (unitary) molded member. It is also preferable that the guide member 71 be molded from any one of a number of known, heat resistant plastic materials, suitable for the particular engine application intended. It should be understood that the guide member 71 shown in FIGS. 2–4 is by way of example only, and is the preferred arrangement for a V-8 engine on which there are two adjacent cylinders associated with the guide member 71, with one cylinder being conventional, and the other being of the deactivating type. However, on a V-6 engine, for example, one whole bank of cylinders may be conventional, while the other entire bank of cylinders is of the deactivating type, and such an arrangement is within the scope of the present invention. In that case, there would be at least two separate guide members which together would comprise the "guide member" recited in the appended claims, and that guide member would define at least one receptacle for a conventional roller follower, and at least one receptacle for a deactivating roller follower.

The term "conventional" is used in regard to the portion 73, because the portion 73 defines a pair of substantially identical, generally cylindrical receptacles 81, each of which receives one of the conventional roller followers 21. Similarly, portion 75 is referred to as a deactivating portion because the portion 75 defines a pair of substantially identical, generally cylindrical receptacles 83, each of which receives one of the deactivating roller followers 47.

In accordance with one important aspect of the invention, even though the roller followers 21 and 47 appear, externally, to be almost identical, the roller followers 21 and 47 are made slightly different from each other, and the receptacles 81 and 83 are made different from each other.

Aside from the differences between the receptacles 81 and 83, as will be described in greater detail subsequently, the conventional portion 73 and the deactivating portion 75 may otherwise appear substantially identical except, that in the subject embodiment, the deactivating portion 75 defines an arcuate recess 85 (shown in both FIGS. 3 and 4), which is merely an example of a physical feature of the guide member 71 which may be used to orient the guide member 71 relative to the engine block 11B. Thus, it will be understood that the arcuate recess 85 could, in some engine applications, be formed in the conventional portion 73 instead of in the deactivating portion 75, and could have any number of other sizes, shapes and configurations. It is an important aspect of the invention however for the guide member 71 to include some sort of feature which, upon assembly, ensures that the guide member 71 is properly oriented relative to the engine block 11B.

As will be understood by those skilled in the art, each of the portions 73 and 75 includes two receptacles (either 81 or 83) for roller followers only because, in the subject embodiment of the invention, the engine is of the two-valves-per-cylinder type. Furthermore, in the subject embodiment of the invention, each cylinder which is of the conventional type is disposed immediately adjacent a cylinder which is to be of the deactivating type, and therefore, each follower guide member 71 is formed to have the conventional portion 73 and the deactivating portion 75 combined in a single guide member 71.

Referring now primarily to FIGS. 7 and 8, one important aspect of the invention will be described. FIG. 7 shows the preferred embodiment of an upper portion 87 of the outer body member 53 of the conventional roller follower 21. The upper portion 87 is generally cylindrical, and has a slightly smaller diameter than that of the receptacle 81, and includes a pair of flats 89. The receptacle 81 defines a pair of flats 91 which are configured such that when the upper portion 87 is inserted into the receptacle 81, the engagement of the flats 89 within the flats 91 will be sufficient to hold the roller follower 21 in the position shown in FIG. 2 during the assembly process. The engagement should also be sufficient so that the "torque-to-turn", i.e., the amount of torque it would take to turn the roller follower 21 in the receptacle 81 would be greater that what is exerted on it during normal operation.

FIG. 8 shows the preferred embodiment of an upper portion 93 of the outer body member 53 of the deactivating roller follower 47. The upper portion 93 is also generally cylindrical, and has a slightly smaller diameter than that of the receptacle 83 (which may be the same as the receptacle 81 diameter), and the upper portion 93 includes a pair of flats 95, which appear very similar to the flats 89, but in accordance with an important aspect of the invention, the flats 95 are somewhat narrower than the flats 89 or, stated another way, the flats 95 are further apart than are the flats 89, for reasons which will become apparent subsequently. The one flat 95 includes an elongated rib 97 which extends along the axial length of the flats 95. The receptacle 83 defines a pair of flats 99 which are configured such that when the upper portion 93 is inserted into the receptacle 83, the engagement of the flats 95 within the flats 99 will be sufficient to hold the roller follower 47 in the position shown in FIG. 2 during the assembly process.

Figure 9:
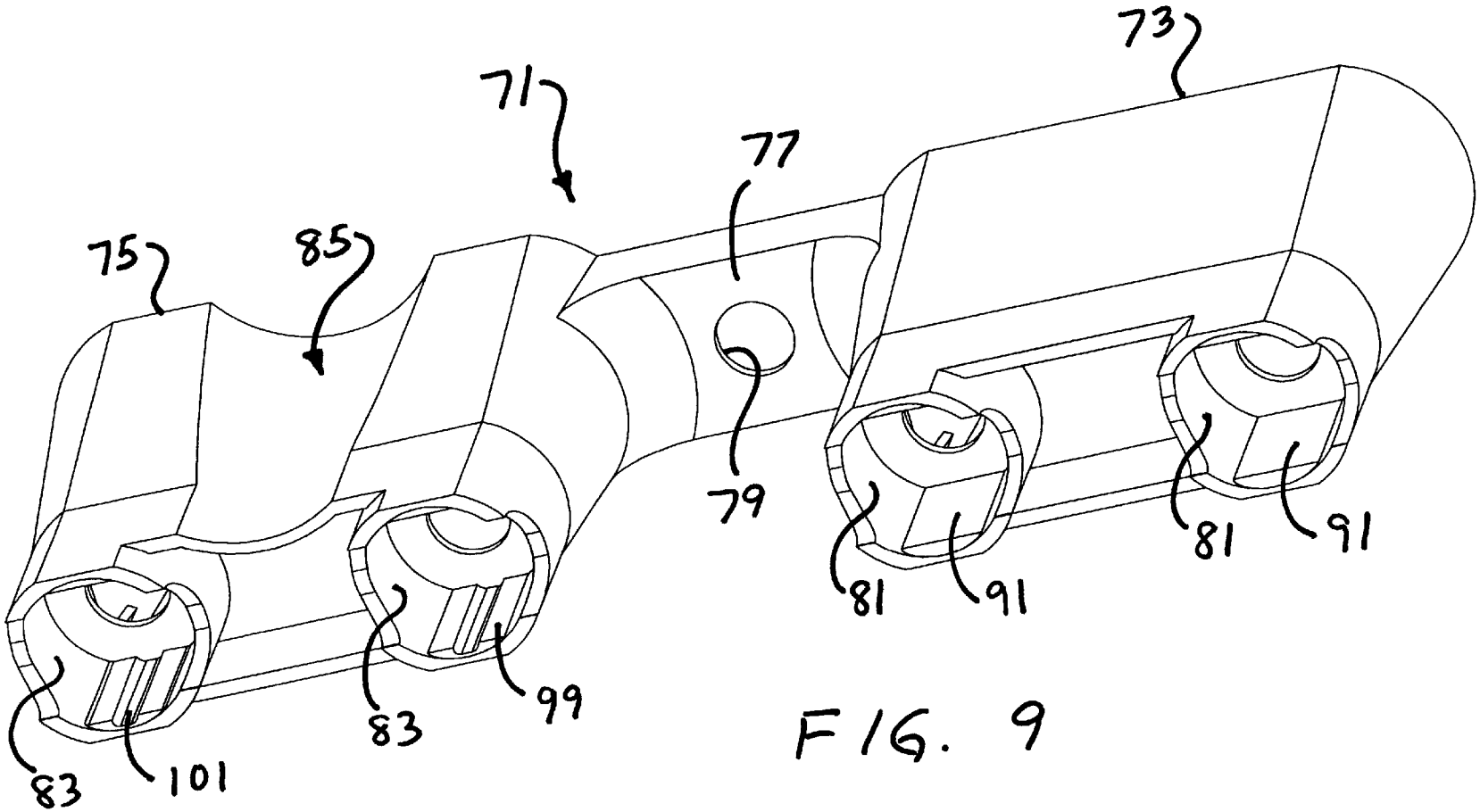
FIG. 9 is a bottom, perspective view of the follower guide member of the present invention, but viewed from the opposite direction as in FIG. 2.

One of the flats 99 includes an elongated notch 101 (see also FIG. 9) which receives the rib 97, so that the roller follower 47 can be inserted within the receptacle in only one rotational orientation, thus insuring that the pressure port 69 is in proper alignment (and communication) with the pressure passage in the engine block 11B.

During the assembly process, if an attempt is made to locate one of the deactivating roller followers 47 in a conventional receptacle 81, the flats 95 being further apart, plus the presence of the rib 97, will prevent the insertion of the upper portion 93 into the receptacle 81. If, on the other hand, an attempt is made to locate one of the conventional roller followers 21 in a deactivating receptacle 83, the fact that the flats 89 are closer together than the flats 99 will permit insertion of the upper portion 87 into the receptacle 83. However, when the guide member 71 is picked up and held in the position shown in FIG. 2, in preparation for assembly to the engine block 11B, the conventional roller follower 21, which has been erroneously placed in a deactivating location (receptacle 83) will simply fall out of the receptacle 83, thus alerting the assembler of the error.

Therefore, as used hereinafter in the appended claims, the term "not being capable of receiving" in regard to the upper portions 87 and 93 being incorrectly inserted into the receptacles 83 and 81, respectively, will be understood to mean either that the upper portion literally won't fit into the receptacle, or that the upper portion will fit into the receptacle, but won't be retained in the receptacle when the guide member is held in the position shown in FIG. 2. It should also be apparent to those skilled in the art that what is important in the present invention is not the particular configuration of flats, ribs and notches shown herein, but the ability to make each type of roller follower not be capable of being "received" (as defined above) within the wrong receptacle. Therefore, those skilled in the art will understand that shapes other than flats, ribs and notches may, within the scope of the invention, be utilized to accomplish the intended purpose of preventing erroneous assembly, while at the same time correctly orienting at least the deactivating roller follower rotationally.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

What is claimed is:

1. A valve actuation sub-assembly for an internal combustion engine of the type having a valve means for controlling the flow to and from a combustion chamber, valve gear means operative in response to a cyclical input motion to effect cyclical opening and closing of said valve means; said valve actuation sub-assembly being adapted for attachment relative to an engine block including a cam shaft defining first and second cam profiles operable to provide said cyclical input motion in response to rotation of said cam shaft, said engine block defining first and second follower bores disposed adjacent said first and second cam profiles, respectively; said valve actuation sub-assembly comprising first and second roller followers, to be disposed in said first and second follower bores, respectively, each of said roller followers including a roller for operative engagement with its respective cam profile, an outer body fixed to move axially with its roller, said outer body including an upper portion projecting out of its respective follower bore, an inner body disposed within said outer body, and including a push rod socket, and a push rod in engagement with said push rod socket and operable to transmit said cyclical input motion to said valve gear means; said valve actuation sub-assembly further comprising a follower guide member adapted for attachment to said engine block and defining first and second guide receptacles operable to receive and guide said upper portions of said outer body of said first and second roller followers, respectively, characterized by:

(a) said first guide receptacle defining a first internal profile configured to be closely spaced relative to said upper portion of said outer body of said first roller follower, said first internal profile not being capable of receiving said upper portion of said outer body of said second roller follower; and (b) said second guide receptacle defining a second internal profile configured to be closely spaced relative to said upper portion of said outer body of said second roller follower, said second internal profile not being capable of receiving said upper portion of said outer body of said first roller follower.

2. A valve actuation sub-assembly as claimed in claim 1, characterized by said first roller follower comprises a conventional roller follower, and said second roller follower comprises a deactivating roller follower, and includes a latching arrangement operable between a latched condition, latching said inner body for movement with said outer body, and an unlatched condition, permitting relative axial movement between said outer body and said inner body.

3. A valve actuation sub-assembly as claimed in claim 1, characterized by said follower guide member comprising a unitary member molded from a heat resistant plastic material.

4. A valve actuation sub-assembly as claimed in claim 1, characterized by said upper portions of said outer bodies of said first and second roller followers being generally cylindrical, and defining at least one flat, and each of said first and second guide receptacles defining corresponding flats, one of said flats defined by said upper portions being wider than the other, whereby said upper portion having the narrower flat will not fit within the guide receptacle intended to receive said upper portion having said wider flat.

5. A valve actuation sub-assembly as claimed in claim 4, characterized by said upper portions each defining a pair said flats, and each of said first and second guide receptacles defining a pair of corresponding flats, and one of said pair of said flats defined by said upper portion of said second roller follower including an elongated rib, and in said second guide receptacle, one of said flats defined by said guide receptacle defining a mating, elongated notch adapted to receive said elongated rib, whereby said upper portion can have only one rotational orientation within said second guide receptacle.

6. A valve actuation sub-assembly as claimed in claim 1, characterized by said follower guide member defining a unique feature on its exterior, whereby said guide member can be assembled relative to said engine block in only its correct orientation.

* * * * *